US007681992B2

(12) United States Patent
Omata et al.

(10) Patent No.: US 7,681,992 B2
(45) Date of Patent: Mar. 23, 2010

(54) ELEMENT SUBSTRATE, AND PRINTHEAD, HEAD CARTRIDGE, AND PRINTING APPARATUS USING THE ELEMENT SUBSTRATE

(75) Inventors: Koichi Omata, Kawasaki (JP); Yoshiyuki Imanaka, Kawasaki (JP); Souta Takeuchi, Yokohama (JP); Takaaki Yamaguchi, Yokohama (JP); Kousuke Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 388 days.

(21) Appl. No.: 11/860,794

(22) Filed: Sep. 25, 2007

(65) Prior Publication Data

US 2008/0084440 A1 Apr. 10, 2008

(30) Foreign Application Priority Data

Oct. 4, 2006 (JP) ..... 2006-273414

(51) Int. Cl.
*B41J 2/04* (2006.01)
*B41J 2/05* (2006.01)

(52) U.S. Cl. ..... 347/57

(58) Field of Classification Search ..... 347/56, 347/57, 58, 59

See application file for complete search history.

(56) References Cited

U.S. PATENT DOCUMENTS

| | | | | |
|---|---|---|---|---|
| 6,290,334 | B1 | 9/2001 | Ishinaga et al. | |
| 7,125,105 | B2 * | 10/2006 | Oomura | 347/58 |
| 7,267,429 | B2 * | 9/2007 | Furukawa | 347/57 |
| 7,559,626 | B2 * | 7/2009 | Sakurai et al. | 347/50 |
| 7,559,628 | B2 * | 7/2009 | Sakurai | 347/57 |
| 2006/0125872 | A1 | 6/2006 | Sakurai | |
| 2006/0139412 | A1 | 6/2006 | Sakurai et al. | |
| 2006/0209131 | A1 | 9/2006 | Furukawa | |

OTHER PUBLICATIONS

U.S. Appl. No. 11/974,282, filed Nov. 29, 2007.
U.S. Appl. No. 11/958,520, filed Dec. 18, 2007.

* cited by examiner

*Primary Examiner*—Huan H Tran
(74) *Attorney, Agent, or Firm*—Fitzpatrick, Cella, Harper & Scinto

(57) ABSTRACT

This invention relates to a printhead element substrate having a plurality of electrothermal transducers and a plurality of switching elements which drive the plurality of electrothermal transducers. The element substrate has a level converter which is shared by adjacent electrothermal transducers and steps up an input driving signal, and a switch circuit which supplies the driving signal output from the level converter to one of the adjacent electrothermal transducers. The switch circuit switches the supply destination of the driving signal in accordance with an external input selection signal.

13 Claims, 17 Drawing Sheets

ELEMENT SUBSTRATE, AND PRINTHEAD, HEAD CARTRIDGE, AND PRINTING APPARATUS USING THE ELEMENT SUBSTRATE

BACKGROUND OF THE INVENTION

1. Field of the Invention

The present invention relates to a printhead element substrate suitable for an inkjet printhead, and a printhead, head cartridge, and printing apparatus using the element substrate.

2. Description of the Related Art

Generally, electrothermal transducers (heaters) of a printhead and their driving circuits in an inkjet printing apparatus are formed on a single substrate using a semiconductor process technology, as described in U.S. Pat. No. 6,290,334.

FIG. 3 is a view schematically showing a semiconductor element substrate of this type for an inkjet printhead.

Referring to FIG. 3, heaters and driving circuits are integrally built in an element substrate 100 by a semiconductor process technology. Reference numeral 101 denotes a driver & heater array in which a plurality of heaters and a plurality of driver transistors serving as switching elements which are provided in correspondence with the heaters and switch whether to direct a current flow to the heaters are arrayed. Ink supply ports 102 supply ink from the lower surface of the element substrate.

A shift register (S/R) 103 temporarily holds print data. A decoder 107 outputs a block enable signal to time-divisionally drive blocks of the heaters in the driver & heater array 101. Input circuits 104 include buffer circuits to input digital signals to the shift registers 103 and decoders 107. Input terminals 110 include a Vdd terminal to input a logic element voltage Vdd, a CLK terminal to input a clock (CLK) signal, and a DATA terminal to input print data (DATA).

The digital circuits such as the shift registers and decoders are driven by a digital power supply voltage (voltage VDD). A level converter 116 converts a digital signal such as the VDD voltage driving signal into a VHT voltage signal to be given to the gate of each driver transistor. The voltage VHT is higher than the voltage VDD. A VHT voltage generation circuit 130 generates the voltage VHT to be supplied to the level converter 116 by stepping down a heater driving power supply voltage (VH). An AND circuit 119 serves as a heater selection circuit which calculates the logical product of a block enable signal and a print data signal. The AND circuit 119 includes, e.g., a buffer as needed.

FIG. 5 is a timing chart for explaining a series of operations of sending a print data signal to the shift register 103 and supplying a current to the heaters to drive them.

Print data is input to the DATA_A and DATA_B terminals in synchronism with the pulse of a clock signal input to the CLK terminal. The shift register 103 temporarily stores the input print data. A latch circuit holds the print data in accordance with a latch signal input to an LT terminal. After that, the logical product of a block enable signal to select a heater group divided into desired blocks and the signal of print data (print data signal) held according to the latch signal is calculated. The signal of the calculated logical product synchronizes with an HE signal that directly determines the current driving time so that a current flows to desired heaters. The series of operations is repeated for the respective blocks, thereby executing printing.

FIG. 4A is an equivalent circuit diagram corresponding to one segment having one heater and a corresponding driver in a conventional printing element. FIG. 4B is an equivalent circuit diagram corresponding to one bit of the shift register and latch circuit to temporarily store print data.

The block enable signal input to an AND circuit 201 is supplied from the decoder 107. The block enable signal selects each heater group corresponding to one of divided blocks. The print data signal input to the AND circuit 201 is a signal input to the shift register 103 and held according to the latch signal. To selectively drive the heaters, the AND circuit 201 serving as a heater selection circuit calculates the logical product of the block enable signal and print data signal.

Reference numeral 205 denotes a VH power supply line; 206, a heater; and 207, a driver transistor serving as a switching element to direct a current flow to the heater 206. An inverter circuit 202 receives and buffers the output from the AND circuit 201. A VDD power supply line 203 serves as a power supply of the inverter circuit 202. A VHT power supply line 204 serves as a power supply to apply a voltage to the gate of the driver transistor 207. An inverter circuit 208 receives the voltage from the VHT power supply line. The inverter circuit 208 serves as a buffer to receive the buffer output from the inverter circuit 202.

The inverter circuit 202, shift register 103, and the like are digital circuits in general and operate in accordance with a low or high pulse. A heat enable signal (HE) to designate a heater driving period is also a digital signal. Signal exchange with an external device is done by a low or high logic pulse. The voltage amplitudes of the digital signals are generally 0 V/5 V or 0 V/3.3 V. The power supply voltage of the digital circuits is VDD only. The above-described block enable signal and print data signal are input to the AND circuit 201 as the pulse of the voltage VDD and then input to the inverter circuit 208 of the next stage through the buffer formed from the two inverter circuits 202.

The resistance value in the ON state, i.e., so-called ON resistance of the driver transistor 207 is preferably as low as possible. In this case, since the power consumed by circuits except the heaters is minimized, an increase in the substrate temperature can be prevented, and stable printhead driving is possible. If the ON resistance of the driver transistor 207 is high, a current flows to this portion to make the voltage drop large. This requires to apply a higher voltage to the heater, and the power is wasted.

To reduce the ON resistance of the driver transistor 207, it is necessary to raise the voltage to be applied to the gate of the driver transistor. For this purpose, in the circuit shown in FIG. 4A, it is necessary to convert the voltage into a pulse voltage higher than the voltage VDD. The circuit shown in FIG. 4A has the power supply line 204 of the voltage VHT higher than the voltage VDD so that the buffer circuit including the inverter circuit 208 converts the block enable signal input by the pulse of the voltage VDD into a pulse of the voltage VHT. After conversion, the pulse of the voltage VHT is applied to the gate of the driver transistor 207. That is, signal exchange with an external device and signal processing in the internal digital circuits are done in accordance with the pulse of the voltage VDD (logic circuit driving voltage). In the circuit shown in FIG. 4A, an amplitude conversion circuit (level converter) which converts the voltage into the pulse of the voltage VHT (switching element driving voltage) is added to each segment immediately before driving the gate of the driver transistor 207. In FIG. 3, reference numerals 116 denote the level converters of the plurality of segments.

Generally, a printhead has a plurality of segments arrayed at a high density. When the segments are arranged at a density of, e.g., 600 dpi, the array-direction width per segment is limited to about 42.3 μM. To arrange, in this pitch, all circuits for driving the segments in FIG. 4A, the size in a direction perpendicular to the array direction of the segments needs to increase.

FIG. 9 is an equivalent circuit diagram showing the detailed structure of the level converter portion in FIG. 4A. As is apparent from FIG. 9, since the level converter portion (especially level conversion unit) includes a number of transistors, the area of the necessary element substrate increases.

However, when a level converter is added to each segment, the length of the segment increases. This leads to an increase in the size of the element substrate for the printhead, resulting in an increase in cost. More specifically, in the above-described substrate structure, the element substrate spreads in the direction perpendicular to the segment array direction, and the size of the element substrate conspicuously increases. When a level converter is added to each of, e.g., 256 segments of a printhead, at least 256 inverters are necessary, resulting in an increase in cost.

To solve this problem, U.S. Publication No. 2006/0209131 discloses a circuit arrangement which converts a logic circuit driving voltage into a printing element driving voltage without increasing the length in the direction perpendicular to the segment array direction.

FIG. 10 is a view for explaining the arrangement of U.S. Publication No. 2006/0209131. The same reference numerals as in FIG. 3 denote the same parts in FIG. 10, and a description thereof will not be repeated unless they are particularly different from FIG. 3.

In FIG. 10, the level converter 116 is provided in the output stage of each decoder 107 and the output stage of each shift register 103.

FIG. 2A is an equivalent circuit diagram, different from FIG. 4A, corresponding to one segment having one heater and a corresponding driver in a conventional printing element. FIG. 2B is an equivalent circuit diagram, different from FIG. 4B, corresponding to one bit of the shift register and latch circuit to temporarily store print data.

In the element substrate 100 in FIG. 10, the level converter is added to the output portion of each of the shift registers 103 and decoders 107, unlike the element substrate 100 in FIGS. 3 and 4A in which the level converter is added to each segment. That is, the voltage rises before the AND circuit 201 calculates the logical product of the output signal (block enable signal) from the decoder 107 and the output signal (print data signal) from the shift register 103. Hence, as shown in FIG. 2A, a pulse signal stepped up to the voltage VHT is input to each segment. This obviates the level converter of each segment so that the area of the element substrate can be reduced.

Since a high voltage is applied to the AND circuit 201 that calculates a logical product for each segment, high-voltage-proof elements are necessary as transistors included in the AND circuit 201. Conventionally, the transistors are formed from low-voltage-proof elements because only a low voltage corresponding to the logic circuit driving voltage is applied to this portion. In the technique disclosed in U.S. Publication No. 2006/0209131, the breakdown voltage of this portion is made higher than that for the transistors of the remaining logic circuits. More specifically, high-voltage-proof elements are used as the transistors included in the AND circuit.

When such high-voltage-proof elements (MOS transistors) are used, each transistor becomes larger than a low-voltage-proof transistor. However, the size of the element substrate 100 can be reduced because the number of level converters can be small, and they can be located far from the segments.

FIG. 2B is a circuit diagram showing the arrangements of the shift register 103 and level converter 116. The level converter (amplitude conversion circuit) is added to the output stage of the shift register 103 shown in FIG. 4B to convert the pulse voltage from the voltage VDD to the voltage VHT.

The number of output stages of the shift register 103 or decoder 107 is determined by the division count in time-divisionally driving all segments. The division count is about 8 to 32. For example, when 256 segments are divided into 16 blocks (each block includes 16 segments), the necessary number of level converters 116 is 16×2 (shift register side and decoder side)=32. The number greatly decreases as compared to the arrangement with the level converters 116 added to all segments. For this reason, the length of the element substrate 100 in the direction perpendicular to the segment array direction can decrease. The level converters 116 added to the shift registers 103 and decoders 107 increase the length of the element substrate 100 in the array direction. However, this increase is insignificant relative to the decrease in the length in the perpendicular direction. The total area of the element substrate 100 decreases.

An inkjet printing apparatus is required to execute printing at a higher speed. For this reason, the number of orifices of the printhead increases, and the density of the orifices becomes high. Since the number of ink colors, the number of ink supply ports, and the number of orifice arrays also increase, the area of the element substrate becomes large.

FIG. 12 is a view showing the arrangement and vertical positional relationship of two adjacent segments on an element substrate with a segment density of 1,200 dpi. On the element substrate, heaters 206*a* for a medium discharge amount (2.5 pl) and heaters 206*b* for a small discharge amount (1 pl) are arranged at a pitch of 1,200 dpi from the side close to the ink supply port 102. Orifices are schematically illustrated on the heaters. These heaters are connected to transistors 207*a* and 207*b* by wirings (not shown).

Corresponding level converters 116*a* and 116*b* are arranged on the side far from the ink supply port. When the pitch is 1,200 dpi, the array-direction width per segment is only 21 μm. For this reason, it is impossible to arrange two level converters in the segment array direction. Two level converters are arranged in the segment array direction and in the vertical direction. Since the area of a level converter is large, the width of the element substrate increases.

The arrangement disclosed in U.S. Publication No. 2006/0209131 can generally reduce the area of the element substrate but poses several problems in a recently required long-length high-definition head. In FIG. 10 which explains U.S. Publication No. 2006/0209131, the wiring of the high-voltage pulse signal output from the level converter 116 has a long length from one end to the other end of the element substrate in the long side direction. For this reason, consideration from the viewpoint of design must be given to radiation noise. More specifically, it is necessary to ensure a large space between the wirings or pass GND wirings between the wirings.

Recently, it is required to arrange a number of segments at a high density. For example, it is necessary to arrange 512 orifices at 1,200 dpi or 1,024 orifices at 2,400 dpi. When the number of segments increases, the number of wirings for the data signal and the number of wirings for the block enable signal increase. This may also raise the increase ratio of the chip width due to the above-described radiation noise measure and reduce the shrink effect generated by decreasing the number of level converters. FIG. 13 shows this state.

FIG. 13 is a view showing the arrangement and vertical positional relationship of two adjacent segments. On the element substrate, the heaters 206*a* for a medium discharge amount (2.5 pl) and the heaters 206*b* for a small discharge amount (1 pl) are arranged at a pitch of 1,200 dpi from the side close to the ink supply port 102. Orifices are schematically illustrated on the heaters. These heaters are connected to the transistors 207*a* and 207*b* by wirings (not shown). An AND circuit 119 which is operated by a high-voltage signal exists next to each transistor. Reference numeral 118 denotes wirings for a print data signal and block enable signal. The wirings 118 receive a high-voltage pulse signal, as described above. Hence, the high-voltage signal wirings are spaced apart from each other, and GND wirings are arranged between them, as indicated by dotted lines. The area occupied by the wirings 118 increases and cancels the width reducing effect obtained by eliminating level converters near the transistors.

SUMMARY OF THE INVENTION

The present invention is directed to an element substrate, and a printhead, head cartridge, and printing apparatus using the element substrate.

According to the arrangement of the present invention, it is possible to provide an inexpensive printhead element substrate which prevents an increase in the length in a direction perpendicular to the segment array direction even in a long-length high-definition head, and a printhead, head cartridge, and printing apparatus using the element substrate.

According to one aspect of the present invention, preferably, there is provided a printhead element substrate having a plurality of electrothermal transducers and a plurality of switching elements provided in correspondence with the plurality of electrothermal transducers to drive the electrothermal transducers, comprising an electrothermal transducer selection circuit which receives a print data signal and a block enable signal to divide the plurality of electrothermal transducers into a plurality of blocks, and selectively and time-divisionally drive the blocks and outputs a driving signal, a level converter which is provided for a set of a plurality of switching elements corresponding to adjacent electrothermal transducers and steps up the input driving signal, and a selection circuit which selects, from the adjacent switching elements on the basis of an externally input selection signal, a supply destination of the driving signal output from the level converter.

According to another aspect of the present invention, preferably, there is provided a printhead which has an element substrate having a plurality of electrothermal transducers and a plurality of switching elements provided in correspondence with the plurality of electrothermal transducers to drive the electrothermal transducers, the element substrate comprises an electrothermal transducer selection circuit which receives a print data signal and a block enable signal to divide the plurality of electrothermal transducers into a plurality of blocks, and selectively and time-divisionally drive the blocks and outputs a driving signal, a level converter which is provided for a set of a plurality of switching elements corresponding to adjacent electrothermal transducers and steps up the input driving signal, and a selection circuit which selects, from the adjacent switching elements on the basis of an externally input selection signal, a supply destination of the driving signal output from the level converter.

According to still another aspect of the present invention, preferably, there is provided a head cartridge which has a printhead including an element substrate having a plurality of electrothermal transducers and a plurality of switching elements provided in correspondence with the plurality of electrothermal transducers to drive the electrothermal transducers, and an ink tank containing ink, the element substrate comprises an electrothermal transducer selection circuit which receives a print data signal and a block enable signal to divide the plurality of electrothermal transducers into a plurality of blocks, and selectively and time-divisionally drive the blocks and outputs a driving signal, a level converter which is provided for a set of a plurality of switching elements corresponding to adjacent electrothermal transducers and steps up the input driving signal, and a selection circuit which selects, from the adjacent switching elements on the basis of an externally input selection signal, a supply destination of the driving signal output from the level converter.

According to still another aspect of the present invention, preferably, there is provided a printing apparatus which has a printhead including an element substrate having a plurality of electrothermal transducers and a plurality of switching elements provided in correspondence with the plurality of electrothermal transducers to drive the electrothermal transducers, the element substrate comprises an electrothermal transducer selection circuit which receives a print data signal and a block enable signal to divide the plurality of electrothermal transducers into a plurality of blocks, and selectively and time-divisionally drive the blocks and outputs a driving signal a level converter which is provided for a set of a plurality of switching elements corresponding to adjacent electrothermal transducers and steps up the input driving signal, and a selection circuit which selects, from the adjacent switching elements on the basis of an externally input selection signal, a supply destination of the driving signal output from the level converter.

The invention is particularly advantageous since it is possible to provide an inexpensive printhead element substrate which prevents an increase in the length in a direction perpendicular to the segment array direction even in a long-length high-definition head, and a printhead, head cartridge, and printing apparatus using the element substrate.

Further features of the present invention will become apparent from the following description of exemplary embodiments (with reference to the attached drawings).

DESCRIPTION OF THE EMBODIMENTS

The embodiments of the present invention will be described next with reference to the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

An "element substrate" in the description indicates not a simple substrate made of a silicon semiconductor but a substrate with elements and wirings.

An expression "on an element substrate" indicates not only "on the surface of an element substrate" but also "inside of an element substrate near its surface". A term "built-in" indicates not simply "arrange separate elements on a substrate" but "integrally form elements on an element substrate in a semiconductor circuit manufacturing process".

[Inkjet Printing Apparatus]

Figure 6:
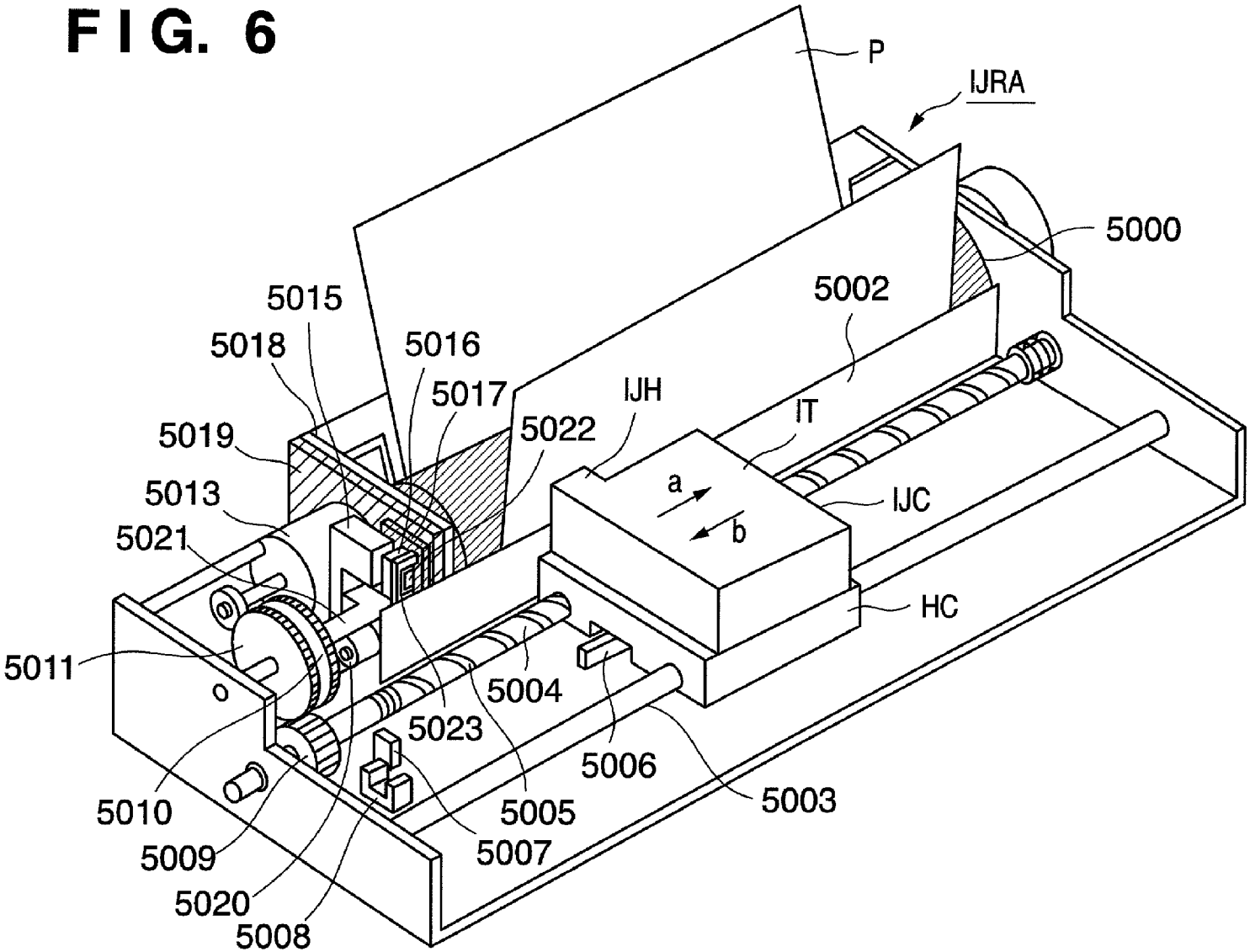
FIG. 6 is an external perspective view showing the schematic arrangement of an inkjet printing apparatus according to a typical embodiment of the present invention.

FIG. 6 is an external perspective view showing the schematic arrangement of an inkjet printing apparatus (IJRA) according to a typical embodiment of the present invention.

Referring to FIG. 6, a carriage HC engages with a helical groove 5004 of a lead screw 5005 which rotates via driving force transmission gears 5009 to 5011 interlockingly with the forward/reverse rotation of a driving motor 5013. The carriage HC has a pin (not shown) and reciprocally moves in the directions of arrows a and b while being supported by a guide rail 5003. An integrated inkjet cartridge IJC incorporating a printhead IJH and an ink tank IT is mounted on the carriage HC. A paper press plate 5002 presses a print medium P against a platen 5000 in the moving direction of the carriage HC. Photocouplers 5007 and 5008 confirm the presence of a lever 5006 of the carriage HC and detect whether the carriage HC is located at the home position to, e.g., switch the rotational direction of the motor 5013. A member 5016 supports a cap member 5022 that caps the front of the printhead IJH. A suction device 5015 sucks the cap to do suction recovery of the printhead through an opening 5023 in the cap.

A cleaning blade 5017 and a member 5019 which moves the blade back and forth are supported by a main body support plate 5018. Not the blade with this form but any other known cleaning blade is applicable to the embodiment. A lever 5021 is used to start suction in suction recovery. The lever 5021 moves as a cam 5020 engaging with the carriage moves. The movement is controlled by a known transfer mechanism such as clutch switching to transfer the driving force from the driving motor.

When the carriage comes to the area on the home position side, a desired process of the capping, cleaning, and suction recovery is executed at a corresponding position by the function of the lead screw 5005. Any other arrangement is applicable to the embodiment if a desired operation can be done at a known timing.

[Control Arrangement of Inkjet Printing Apparatus]

A control arrangement for executing print control of the above described apparatus will be described next.

Figure 7:
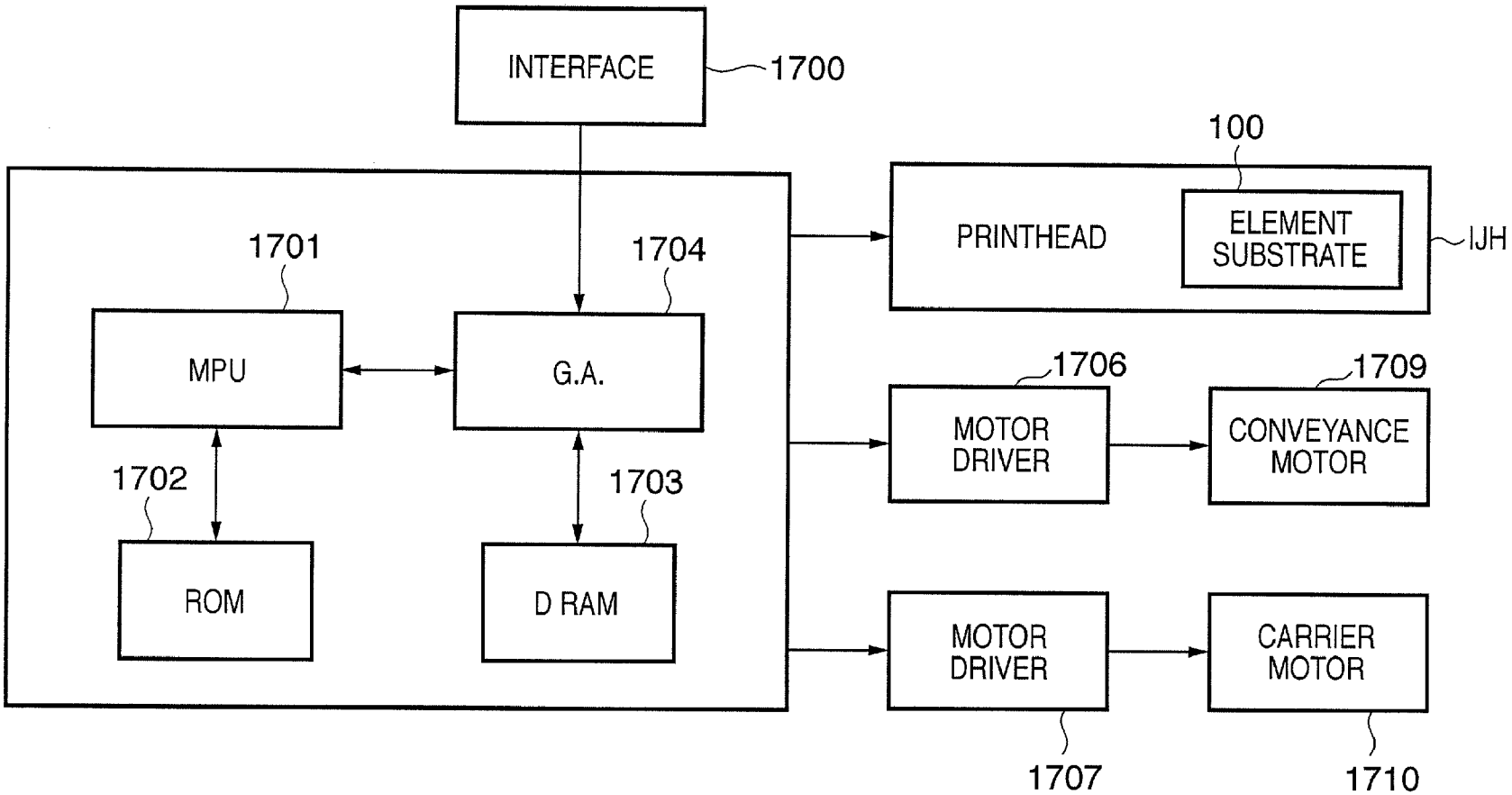
FIG. 7 is a block diagram showing the arrangement of a control circuit of the inkjet printing apparatus according to the typical embodiment of the present invention.

FIG. 7 is a block diagram showing the arrangement of the control circuit of the printing apparatus IJRA.

Referring to FIG. 7, reference numeral 1700 denotes an interface that inputs a print signal from, e.g., a host computer; 1701, an MPU; 1702, a ROM that stores a control program to be executed by the MPU 1701; 1703, a DRAM that saves various kinds of data (e.g., the print signal and print data to be supplied to the printhead IJH). A gate array (G.A.) 1704 controls print data supply to the printhead IJH and data transfer between the interface 1700, MPU 1701, and RAM 1703. A carrier motor 1710 conveys the printhead. A conveyance motor 1709 conveys a print medium. A motor driver 1706 drives the conveyance motor 1709. A motor driver 1707 drives the carrier motor 1710. Reference symbol IJH denotes a printhead. Reference numeral 100 denotes an element substrate.

The operation of the control arrangement will be described. When a print signal is input to the interface 1700, the print signal is converted into print data for printing between the gate array 1704 and the MPU 1701. The motor drivers 1706 and 1707 are driven. In addition, the printhead IJH and element substrate 100 are driven in accordance with the print data so that printing is executed.

[Head Cartridge]

Figure 8:
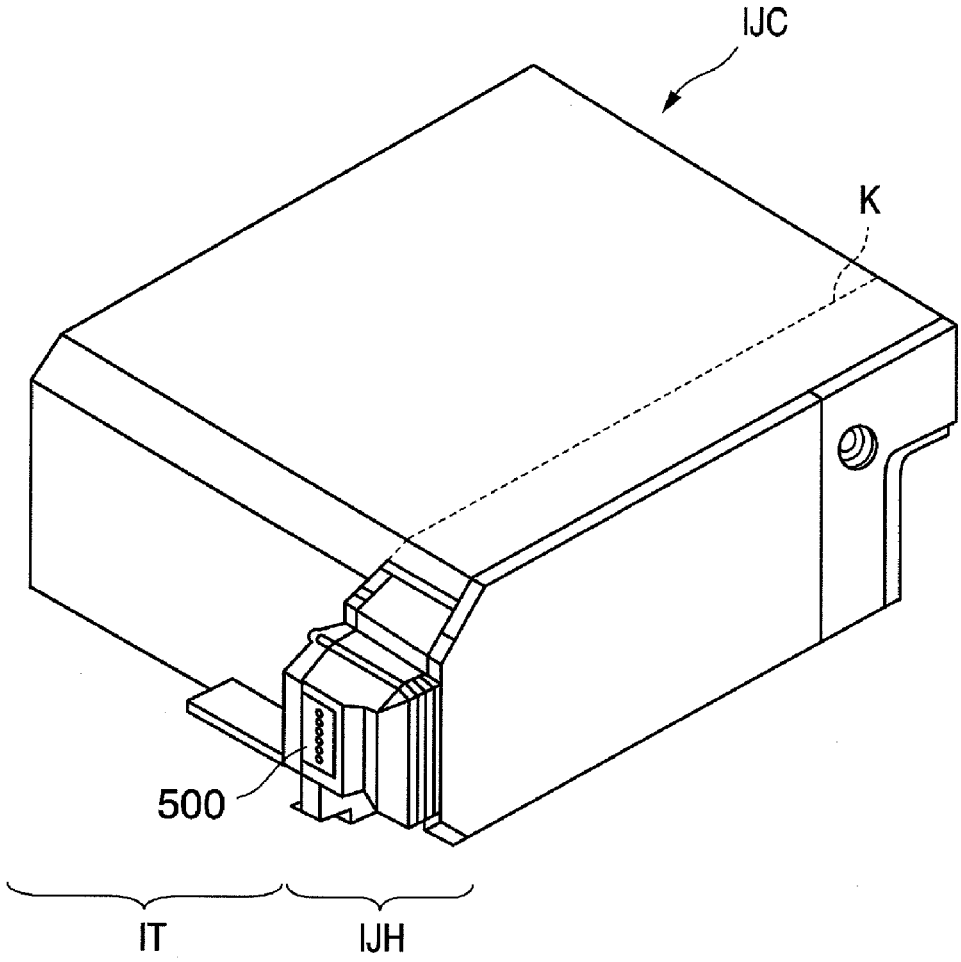
FIG. 8 is an external perspective view showing the arrangement of a head cartridge that integrates an ink tank and a printhead according to a typical embodiment of the present invention.
Figure 9:
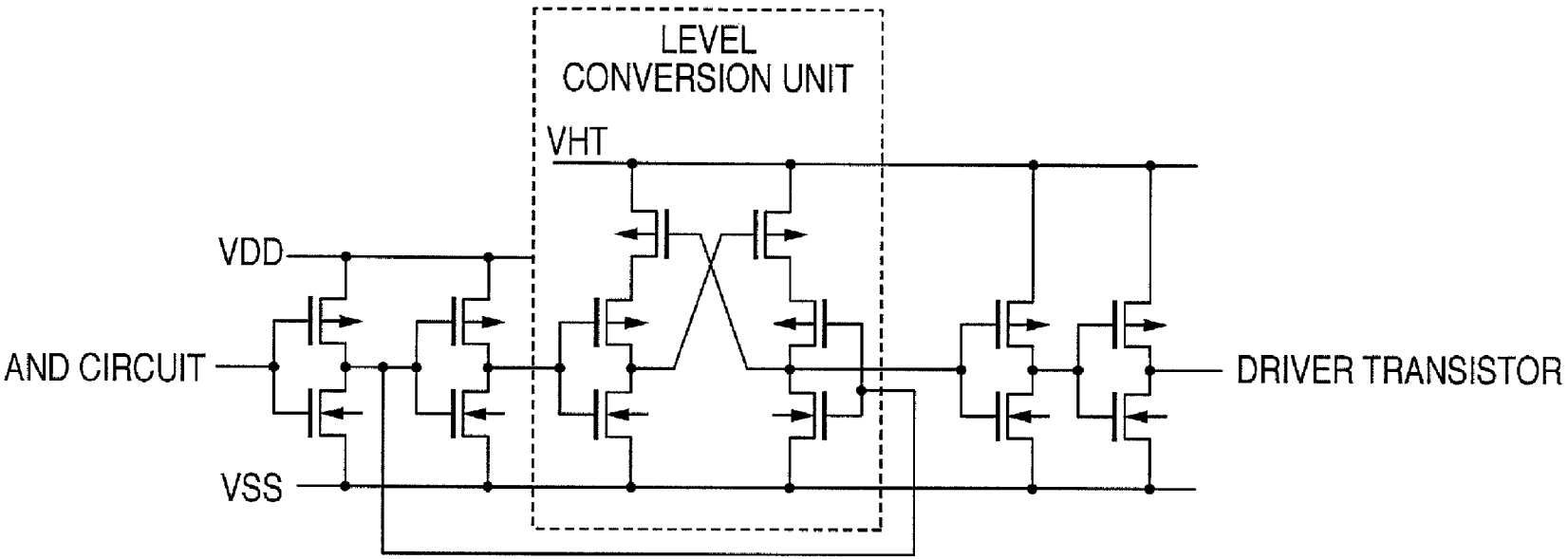
FIG. 9 is an equivalent circuit diagram showing the detailed structure of a conventional level converter portion.

FIG. 8 is an external perspective view showing the arrangement of the head cartridge IJC that integrates the ink tank and printhead. Referring to FIG. 8, a dotted line K indicates the boundary between the ink tank IT and the printhead IJH. The head cartridge IJC has an electrode (not shown) to receive an electrical signal supplied from the side of a carriage 2 when the head cartridge IJC is mounted on the carriage 2. The electrical signal drives the printhead IJH to discharge ink, as described above.

Reference numeral 500 in FIG. 8 denotes an orifice array.

First Embodiment

The result of examinations to the present invention and the effect of the present invention will be explained below in detail by describing the first embodiment.

For an inkjet printhead, element substrate driving method determination and circuit design are done in consideration of a fluid behavior for discharging ink droplets and making them fly in air and land. As fundamental examinations to simultaneously achieve an appropriate element substrate area, high-speed printing, and high-definition image printing, the present inventors examined the relationship between the element substrate driving method and the ink droplet landing accuracy by using a printhead having segments arranged at a density of 1,200 dpi.

In the printhead used for the examinations, orifices for a discharge amount of 1 pl are arranged on a side of the ink supply port at a pitch of 1,200 dpi while similar orifices are arranged on the other side by a shift corresponding to 2,400 dpi. That is, the orifices for a discharge amount of 1 pl are arranged on both sides at a pitch of 2,400 dpi.

As is known, when the number of times of ink droplet discharge per unit time exceeds a predetermined value in a printhead with orifices arranged at a high density, the landing positions on a print medium shift due to airflow caused by the ink droplets themselves especially at an end portion of the orifice array.

This phenomenon become noticeable from printing using a printhead with an orifice density of 600 dpi and more conspicuous in printing using a printhead with a density more than 1,200 dpi. Especially in photo image printing by a serial printer, even a landing position shift of only several μm greatly influences on the image quality. Hence, it was found that the number of orifices to simultaneously discharge cannot exceed a predetermined value. More specifically, even orifices with the same discharge amount are arrayed at a high density, it is necessary to execute printing while thinning the orifices to reduce the number of times of discharge and increase the number of printing passes. For this reason, high-speed printing is impossible even when the orifices are arranged at a high density.

To reduce the total number of times of discharge to prevent the landing position shift due to airflow and enable high-speed printing, orifices for a small discharge amount (e.g., 1 pl) and those for a medium discharge amount (e.g., 2.5 pl) are alternately arranged at the same array density. In forming a print image with a high density, the orifices for a medium discharge amount are used. In this case, the total number of times of discharge can decrease as compared to a case wherein only the orifices for a small discharge amount are used. It is therefore possible to execute high-speed printing by decreasing the number of passes.

As described above, the orifices are arranged in consideration of the fluid behavior of ink droplets, and printing is done while thinning the orifices. Even a long-length printhead having orifices arranged at a high density can exhibit the element substrate area reduction effect at maximum while avoiding the problem posed by the circuit arrangement described in U.S. Publication No. 2006/0209131.

The above description has been done assuming the purpose for coping with airflow. However, the present invention is not limited to this and is applicable to an arrangement which drives a plurality of adjacent heater at different timings.

Figure 1A:
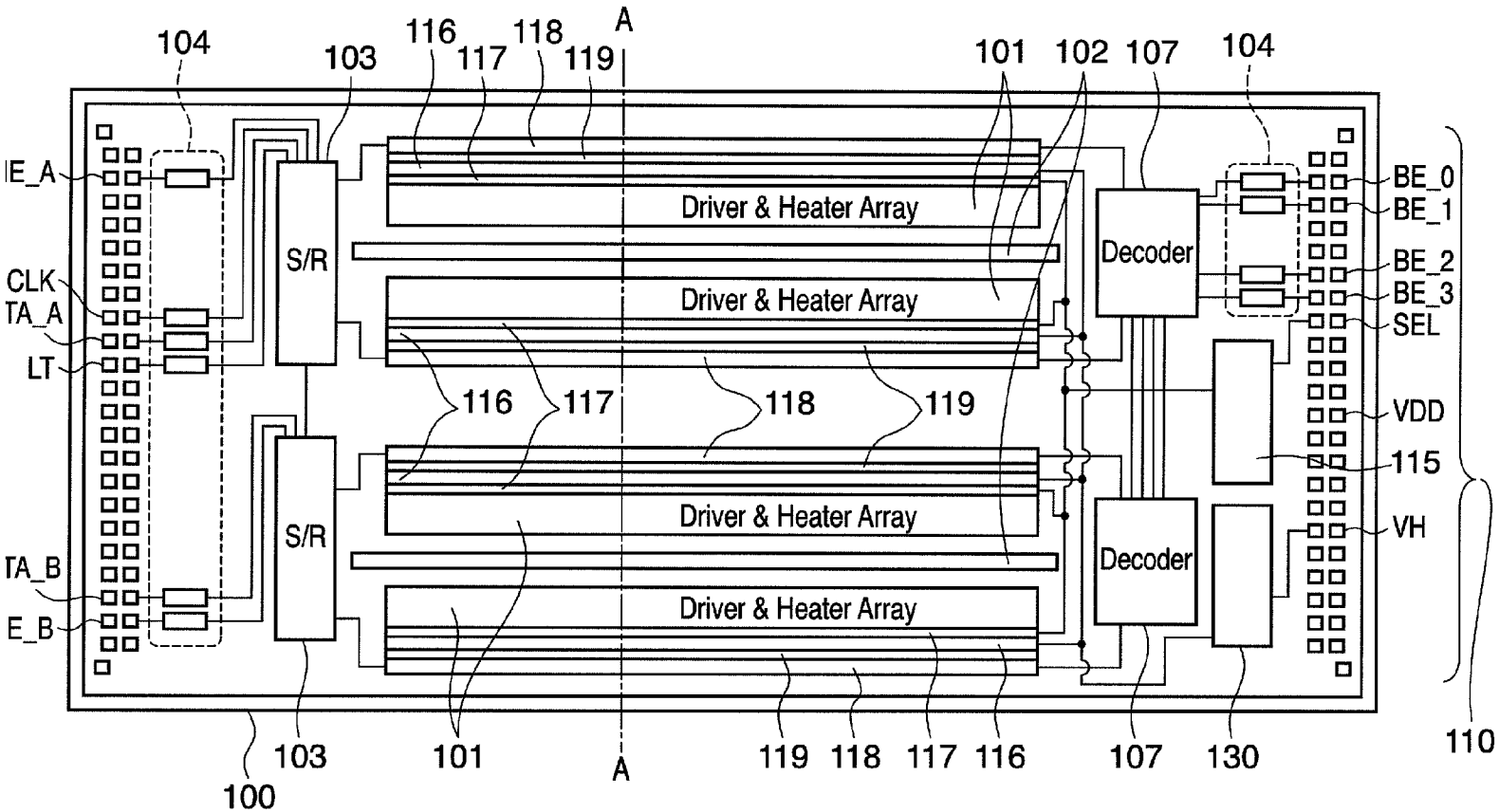
FIGS. 1A and 1B are views showing an inkjet printhead element substrate according to the first embodiment.
Figure 1B:
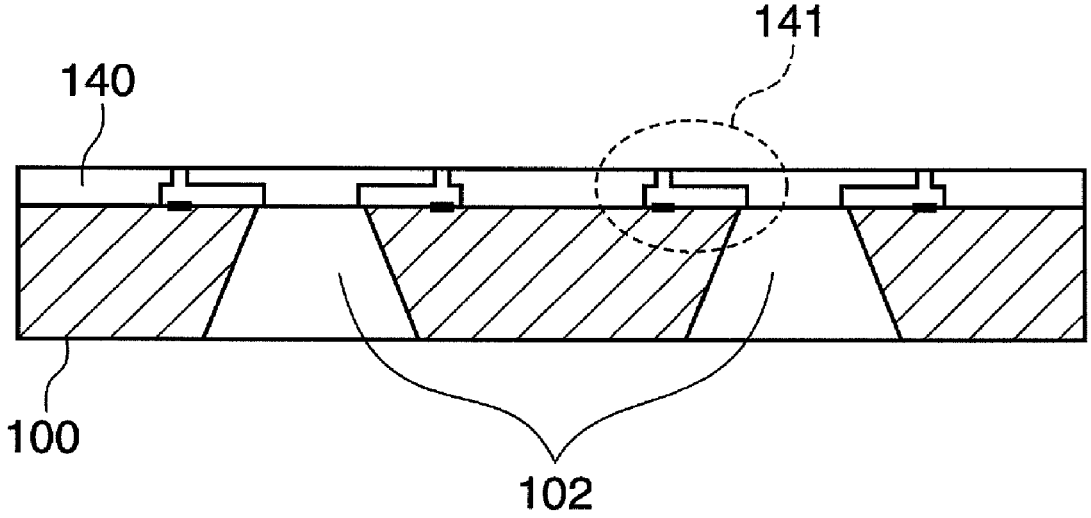
Figure 2A:
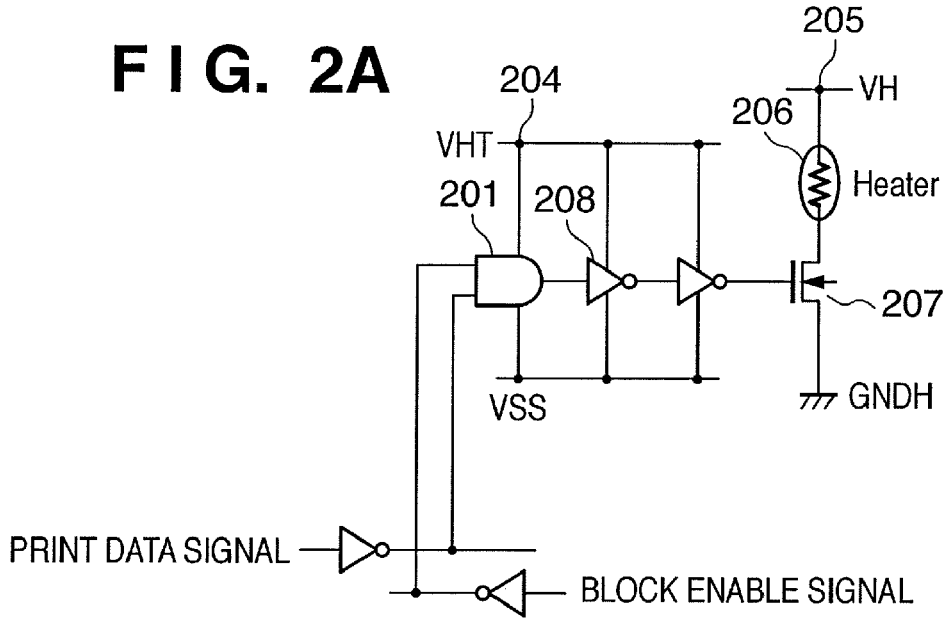
FIGS. 2A and 2B are an equivalent circuit diagram corresponding to one segment of a driver and heater portion in a conventional printing element, and an equivalent circuit diagram corresponding to one bit of a shift register and a latch circuit, respectively.
Figure 2B:
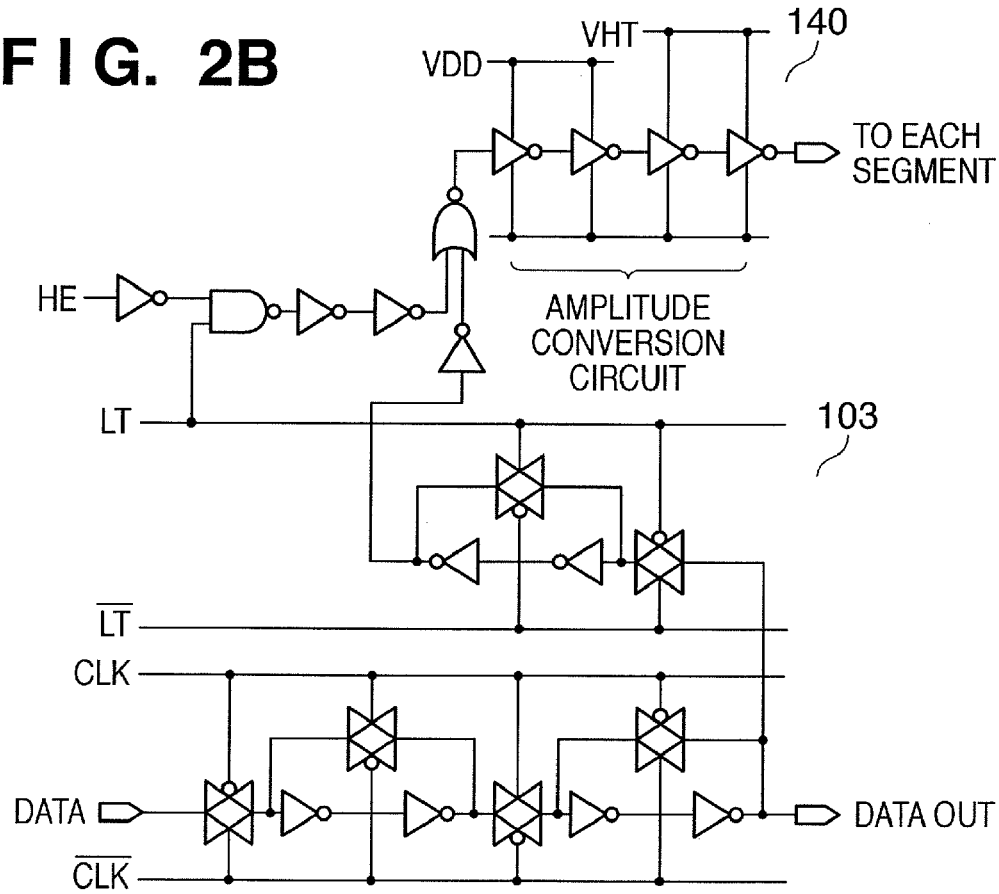

FIGS. 1A and 1B are views showing an inkjet printhead element substrate according to this embodiment.

Figure 3:
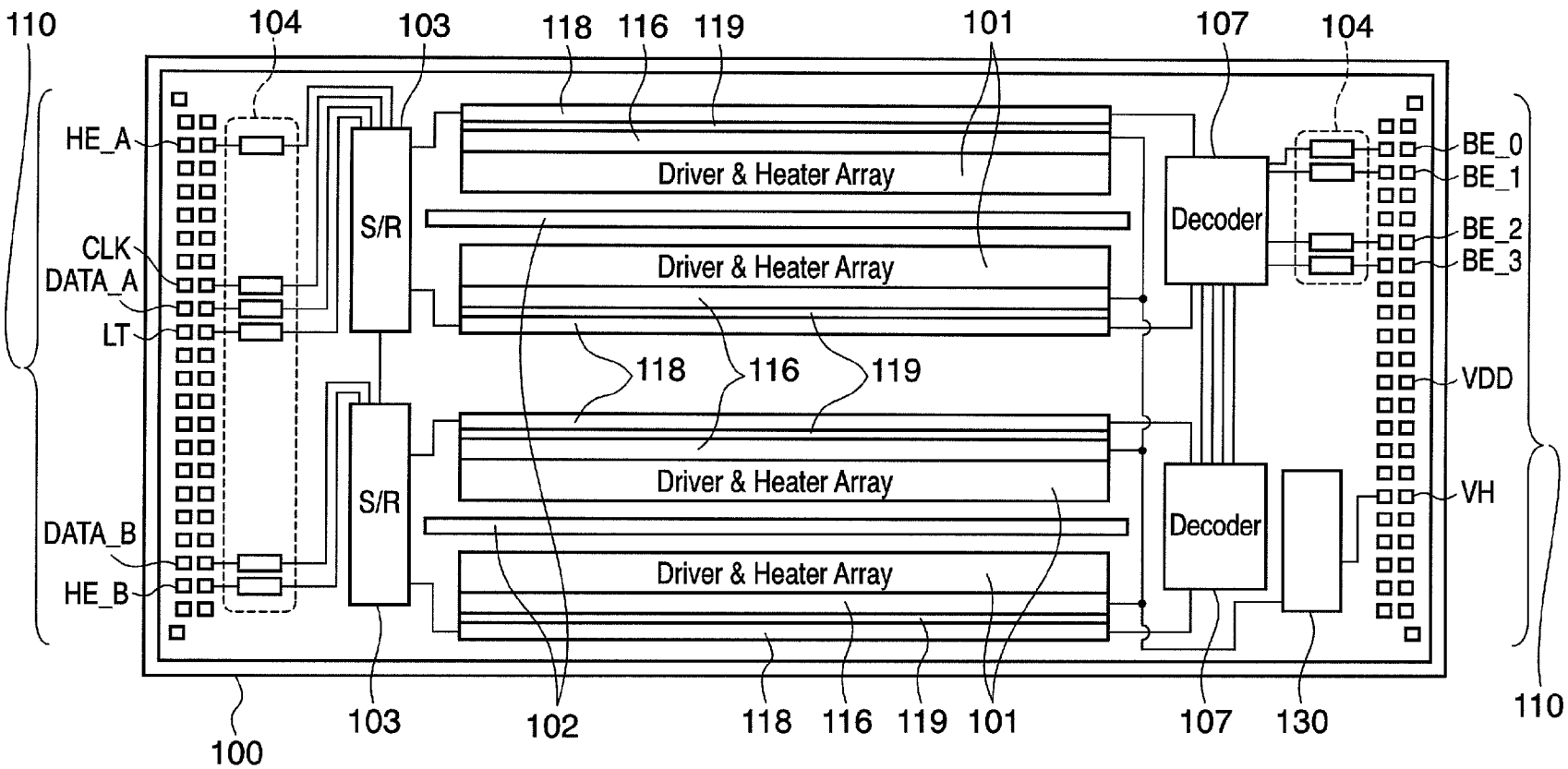
FIG. 3 is a view schematically showing an inkjet printhead element substrate.
Figure 4A:
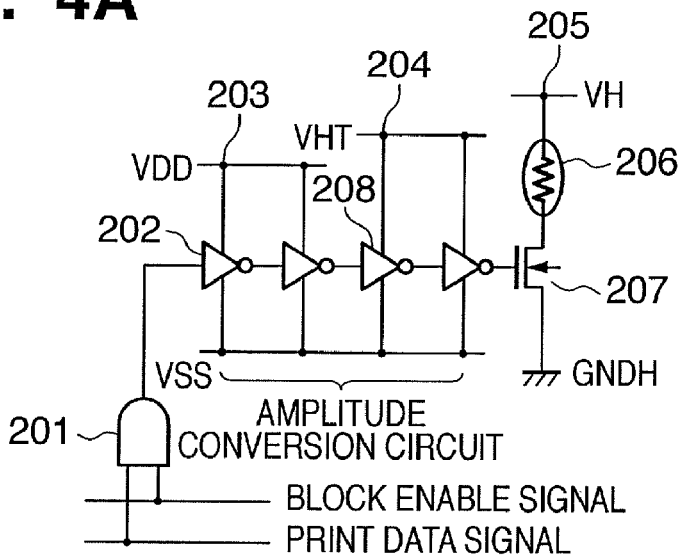
FIGS. 4A and 4B are an equivalent circuit diagram corresponding to one segment of a driver and heater portion in a conventional printing element, and an equivalent circuit diagram corresponding to one bit of a shift register and a latch circuit, respectively.
Figure 4B:
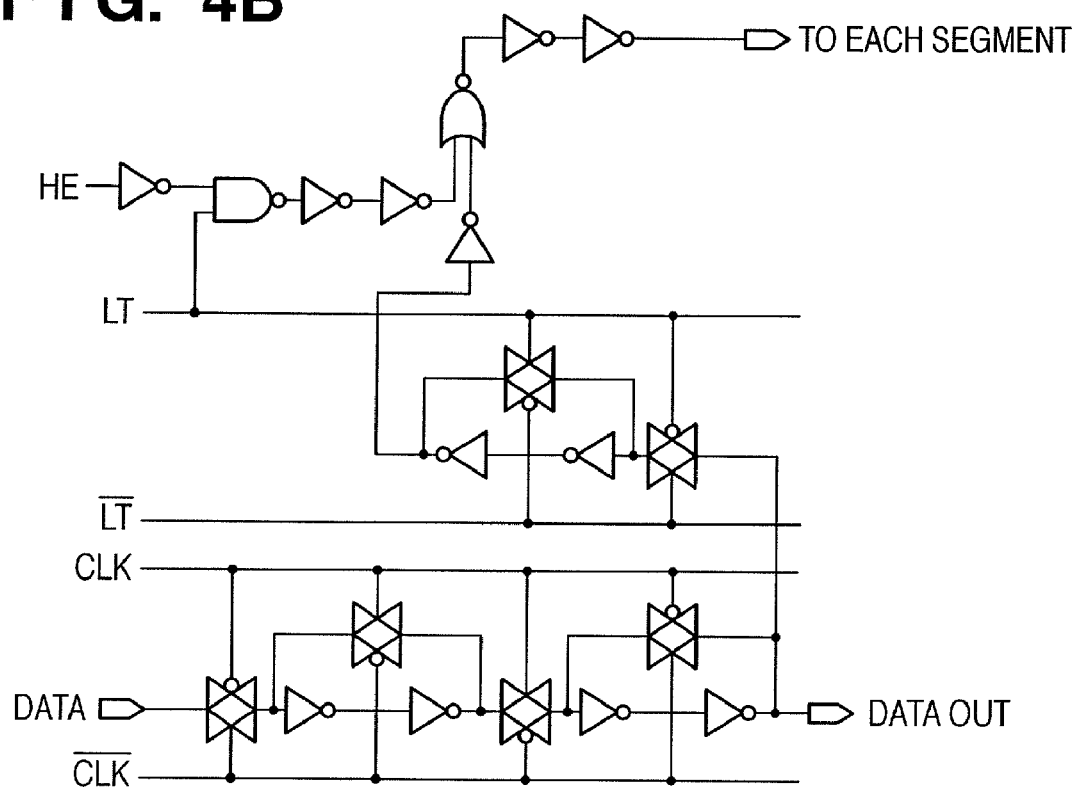
Figure 5:
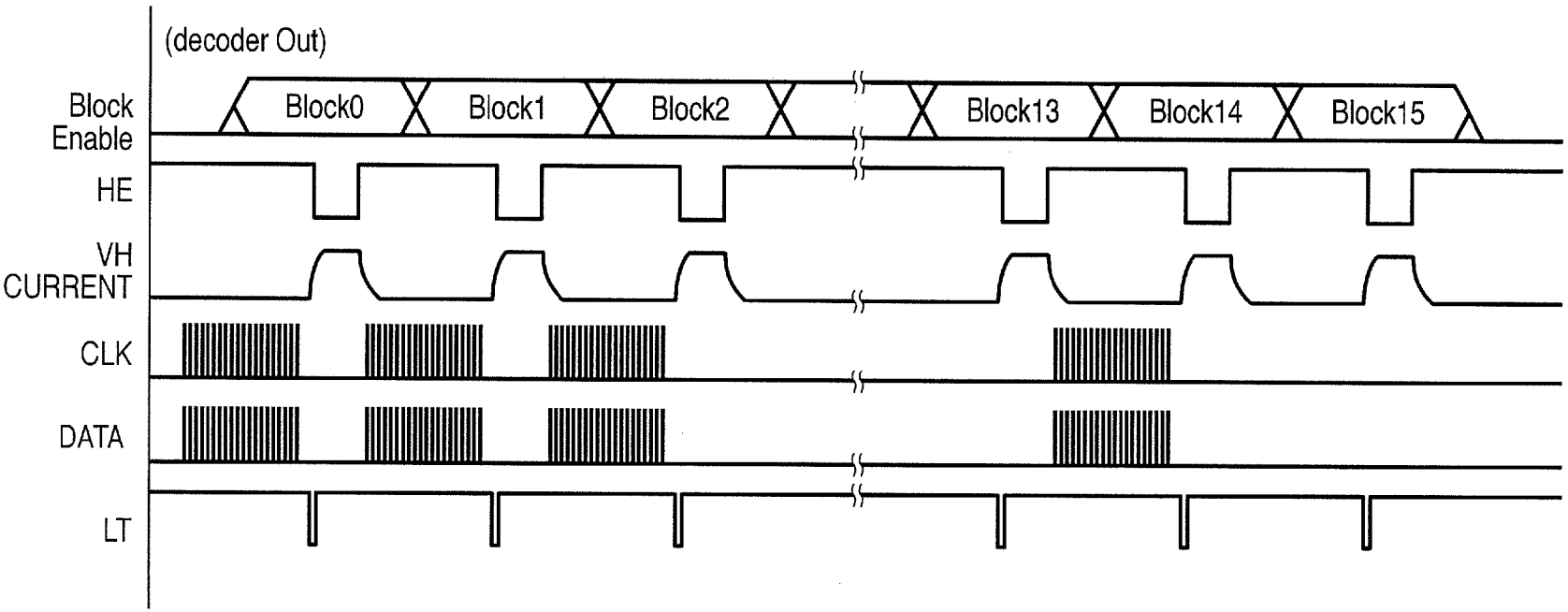
FIG. 5 is a timing chart for explaining a series of operations of sending print information to the shift register and supplying a current to the heaters to drive them.
Figure 10:
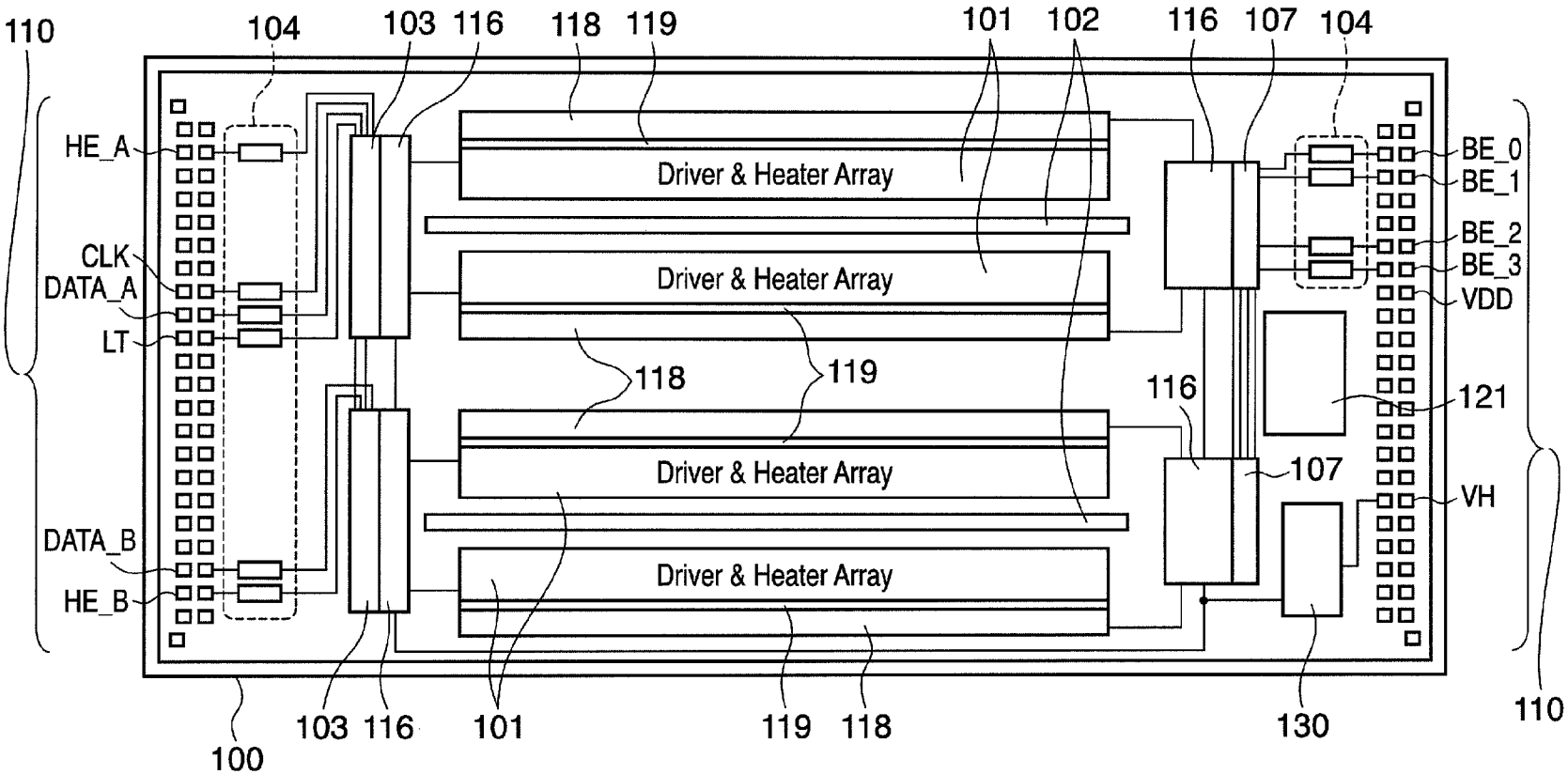
FIG. 10 is a view for explaining a conventional inkjet printhead element substrate.

The same reference numerals as in FIG. 3 or 10 denote the same parts in FIGS. 1A and 1B, and a description thereof will not be repeated unless they are particularly different from FIG. 3 or 10.

Referring to FIG. 1A, a selection signal level converter 115 steps up a selection signal (SEL) (to be described later) to a switching transistor driving voltage (VHT). The selection signal level converter 115 is connected to selection circuits 117 each of which selects heaters to be driven by selecting switching elements to supply a driving signal.

FIG. 1B is a sectional view taken along a line A-A in FIG. 1A. Ink supply ports 102 extend through the element substrate. In FIG. 1B, orifices 141 are formed on the element substrate by using a photosensitive resin 140.

Figure 11:
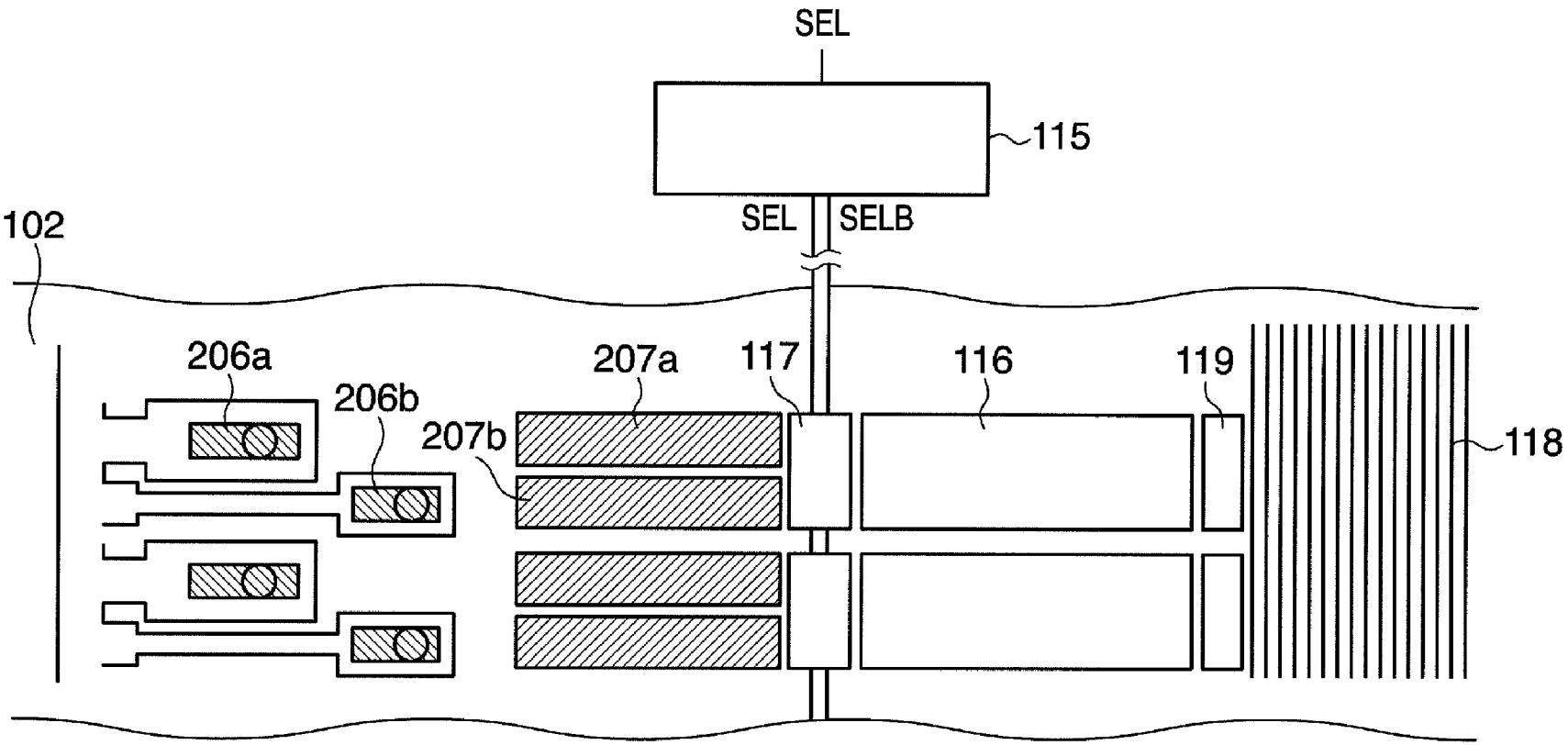
FIG. 11 is a view showing the arrangement and vertical positional relationship of two adjacent segments in FIG. 1A.
Figure 12:
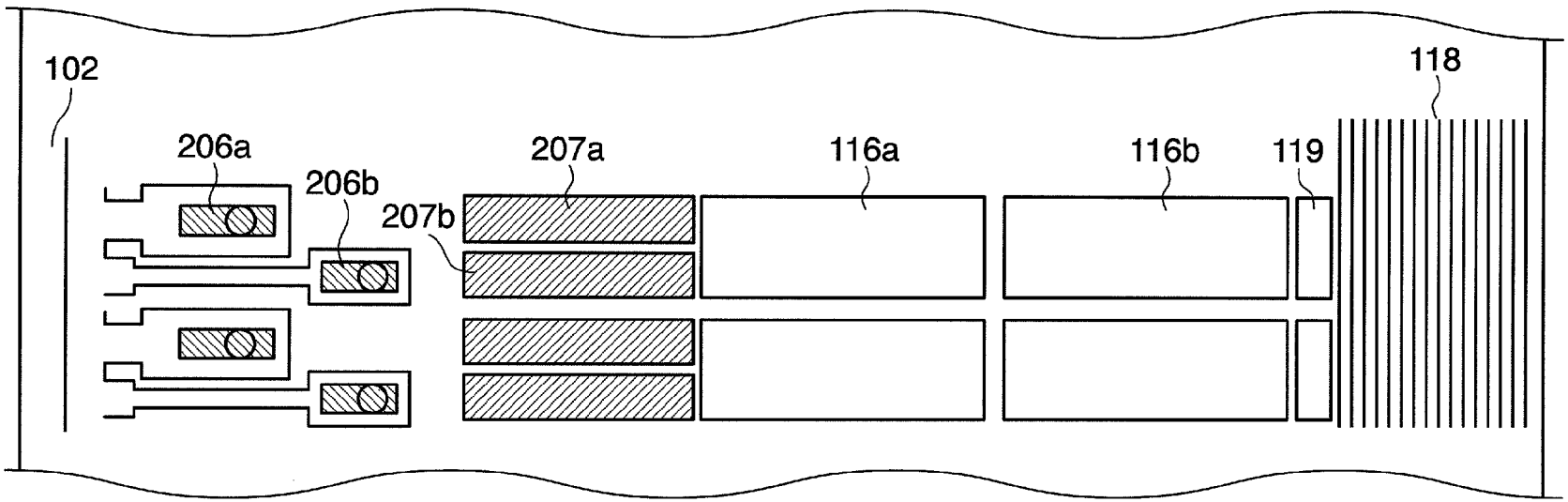
FIG. 12 is a view showing the arrangement and vertical positional relationship of two adjacent segments in a conventional element substrate.
Figure 13:
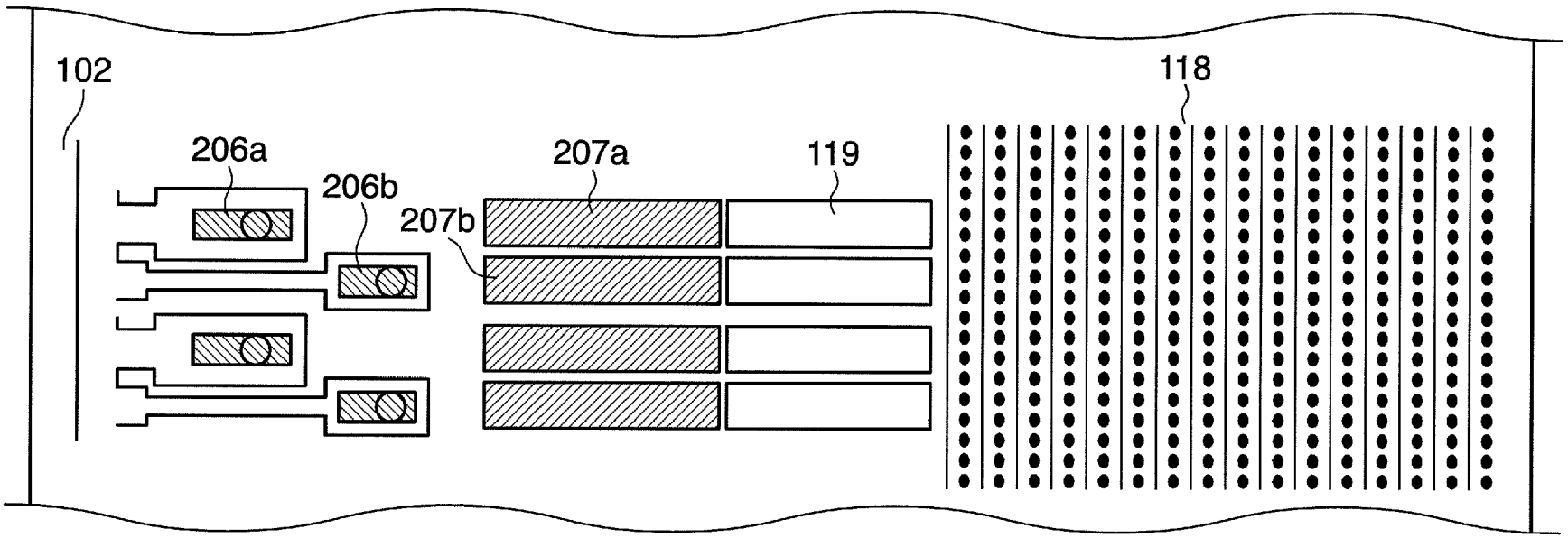
FIG. 13 is a view showing the arrangement and vertical positional relationship of two adjacent segments in a conventional element substrate.
Figure 14:
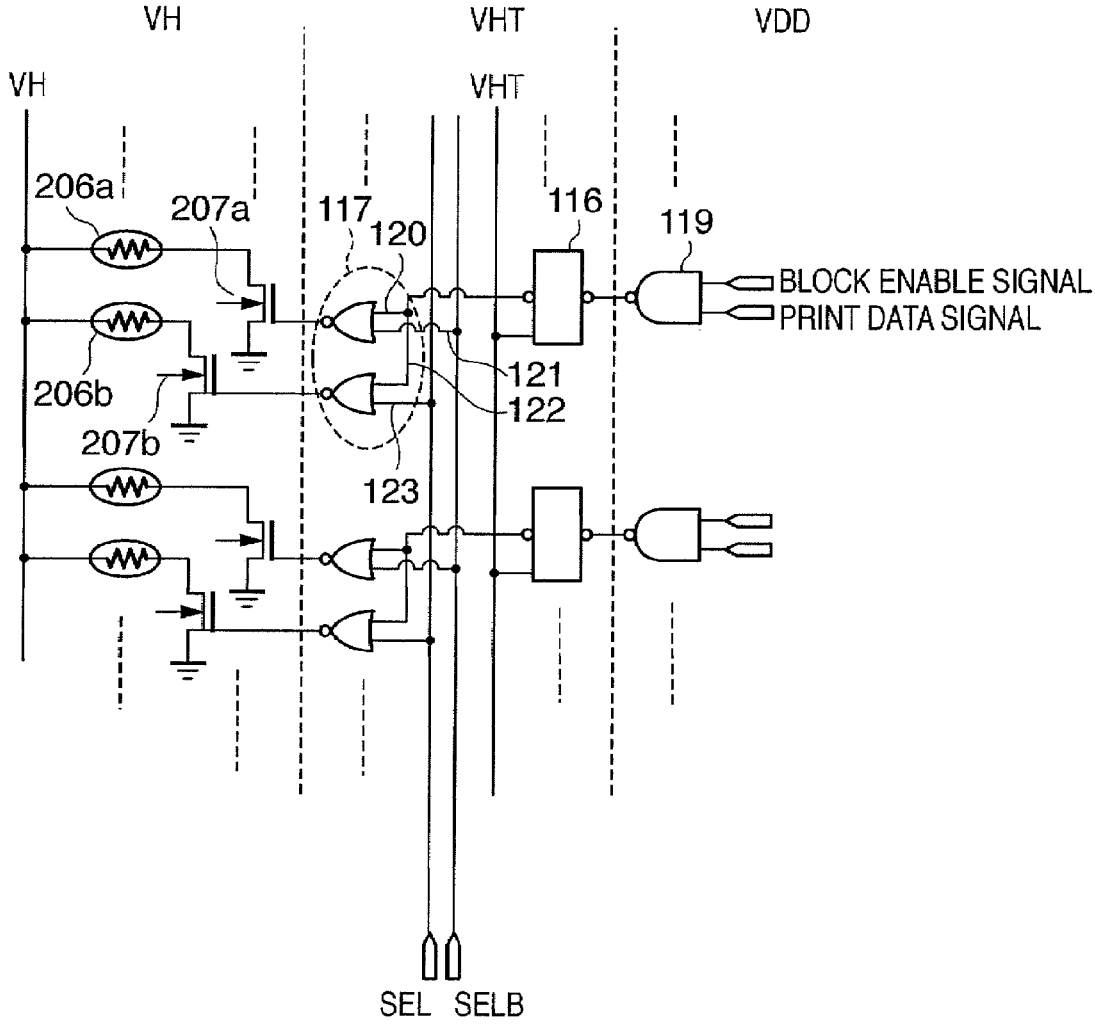
FIG. 14 is a circuit diagram showing the circuits of two adjacent segments in FIG. 1A.

FIG. 11 is a view showing the arrangement and vertical positional relationship of two adjacent segments in FIG. 1A. FIG. 14 is a circuit diagram showing the circuits of two segments adjacent in the direction of the length of the ink supply port 102 in FIG. 1A.

A description will be made with reference to FIG. 11 and corresponding FIG. 14. On the element substrate, heaters 206*a* for a medium discharge amount (2.5 pl) and heaters 206*b* for a small discharge amount (1 pl) are arranged at a pitch of 1,200 dpi from the side close to the ink supply port 102. Orifices are schematically illustrated on the heaters in FIG. 11. These heaters are connected to transistors 207*a* and 207*b* serving as switching elements by wirings (not shown). The selection circuit 117 to select a driving target from the transistors 207*a* and 207*b* is provided between a level converter 116 and the transistors 207*a* and 207*b*.

Reference numeral 118 denotes wirings for a block enable signal as a digital circuit power supply voltage signal and a print data signal. The wirings 118 are arranged in the direction of the length of the ink supply port 102, as shown in FIG. 1A. An AND circuit 119 serves as a heater selection circuit (electrothermal transducer selection circuit) which calculates the logical product of the block enable signal and the print data signal. The heater selection circuit need only selectively drive a heater on the basis of the block enable signal and print data signal, and any arrangement except the AND circuit may be used. The level converter 116 steps up the driving signal output from the AND circuit 119 to the switching transistor driving voltage (VHT). One level converter 116 is provided per set of heaters that are not driven simultaneously (in this embodiment, every set includes two heaters).

The selection signal SEL to select the heaters 206*b* for achieving the small discharge amount or the heaters 206*a* for achieving the medium discharge amount is input from the outside of the element substrate and converted from the digital circuit power supply voltage level into a switching transistor driving voltage level by the selection signal level converter 115 near the connection pad spaced apart from the orifice array. The selection signal level converter 115 supplies the selection signal to the selection circuit 117 connected to the level converter 116 near the orifices through two wirings, i.e., the wirings of SEL and a logically inverted SELB.

A case wherein the heaters 206*a* are driven will be described.

First, 1 (High) is input to the print data signal and block enable signal corresponding to the heaters 206*a* and 206*b*. When 1 (High) is input from the outside of the element substrate to the selection signal SEL, the selection signal level converter 115 steps up the selection signal SEL to the switching transistor driving voltage (VHT). Then, SEL=1 and logically inverted SELB=0 are commonly input to all the selection circuits 117 corresponding to one array arranged in the direction of the length of the ink supply port 102. The signals from the selection signal level converter 115 may commonly be input to selection circuits corresponding to a plurality of arrays.

The selection circuit 117 shown in FIG. 14 includes NOR circuits. One input terminal 120 of the NOR circuit corresponding to the heater 206*a* and transistor 207*a* receives 0 (Low) when the print data signal and block enable signal are 1 (High). The other input terminal 121 receives SELB=0

(Low) when the selection signal SEL is 1 (High). The NOR circuit outputs 1 only when all input terminals receive 0. In this case, the switching transistor 207*a* is driven to flow a current to the heater 206*a*.

On the other hand, the NOR circuit corresponding to the heater 206*b* and transistor 207*b* receives SEL=1 and outputs 0. For this reason, the switching transistor 207*b* is not driven.

To drive the heater 206*b*, 0 is input to the selection signal SEL from the outside of the element substrate. In this case, an input terminal 123 of the NOR circuit corresponding to the heater 206*b* and transistor 207*b* receives SEL=0 so that the NOR circuit outputs 1. The switching transistor 207*b* is driven to flow a current to the heater 206*b*.

On the other hand, the NOR circuit corresponding to the heater 206*a* and transistor 207*a* receives SELB=1 and outputs 0. The switching transistor 207*a* is not driven.

That is, in this embodiment, the switching transistors 207*a* and 207*b* are not driven simultaneously. Instead, they are driven exclusively. For this reason, the adjacent switching transistors 207*a* and 207*b* can share the level converter 116.

This allows to halve the necessary number of level converters 116 corresponding to the headers (206*a* and 206*b*) in this embodiment. Hence, the area of the element substrate can be reduced.

As for the selection signal wiring which is led by a long distance to supply a high-voltage signal, the space between the wirings must be large, or GND wirings must be provided between the wirings. However, only the wirings of the selection signals SEL and SELB are led to supply a high-voltage signal. Many wirings 118 of the block enable signal and print data signal supply a low-voltage signal (digital circuit power supply voltage) as usual. Since the minimum wiring rule is usable as usual, the element substrate area does not increase wastefully.

Second Embodiment

Figure 15A:
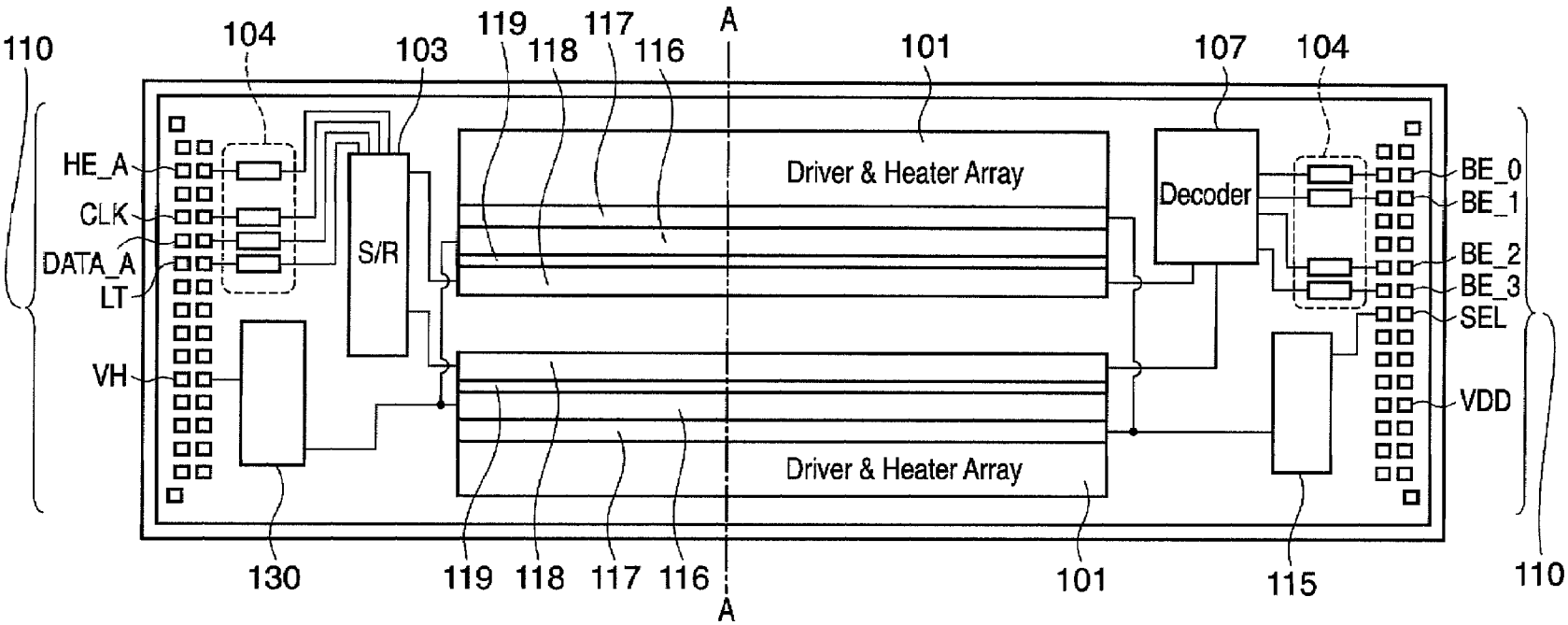
FIGS. 15A and 15B are views showing an inkjet printhead element substrate according to the second embodiment.

FIG. 15A is a view showing an inkjet printhead element substrate according to the second embodiment.

The first embodiment is applied to a printhead in which ink supply ports are provided in an element substrate to supply ink, and ink droplets are discharged in a direction perpendicular to the heater surface (on a side opposing the heater surface). The embodiment shown in FIGS. 15A and 15B is applied to a printhead in which ink is supplied from the edges on both sides of an element substrate to discharge ink droplets in a direction perpendicular to the heater surface.

Figure 15B:
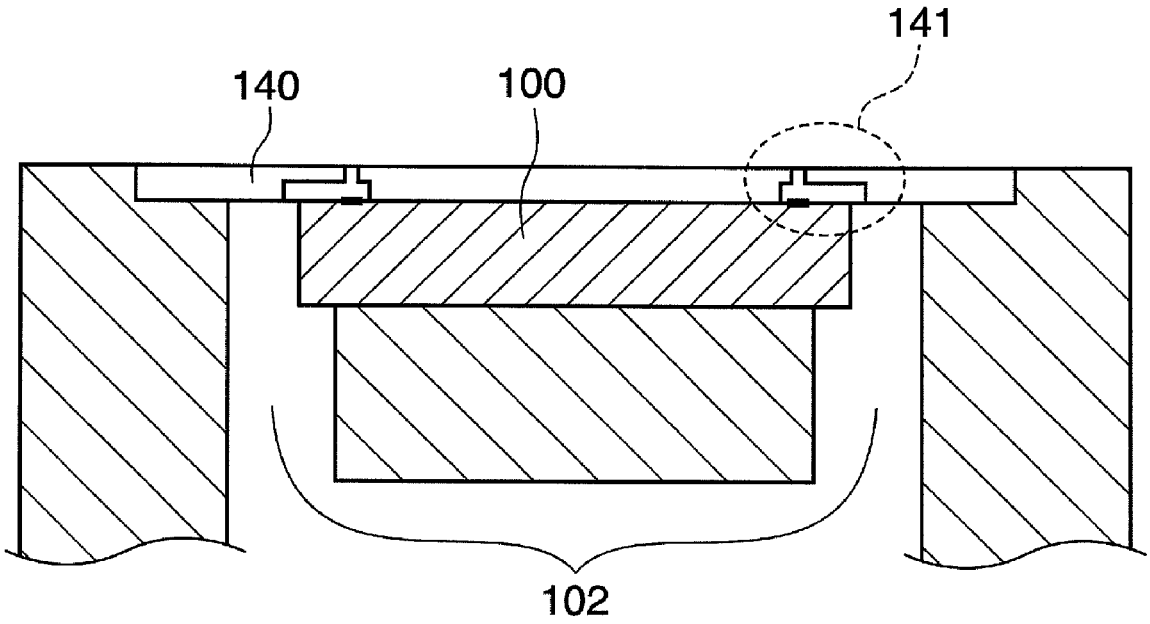

FIG. 15B is a sectional view taken along a line A-A in FIG. 15A. Ink supply ports 102 extend on both sides of the element substrate. In FIG. 15B, orifices 141 are formed on the element substrate by using a photosensitive resin 140.

In the second embodiment, heaters for a small discharge amount and those for a medium discharge amount, which share level converters 116, are alternately arranged and exclusively driven, as in the first embodiment.

Even in this embodiment, since the number of level converters can be reduced, the area of the element substrate can effectively be reduced, as in the first embodiment.

In the first and second embodiments, orifices for different discharge amounts are exclusively driven. The arrangement of the present invention is also applicable to effectively reduce the area of the input terminal even in exclusively driving orifices for the same discharge amount.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-273414, filed Oct. 4, 2006, which is hereby incorporated by reference herein in its entirety.

What is claimed is:

1. A printhead element substrate having a plurality of electrothermal transducers and a plurality of switching elements provided in correspondence with the plurality of electrothermal transducers to drive the electrothermal transducers, comprising:

an electrothermal transducer selection circuit which receives a print data signal and a block enable signal to divide the plurality of electrothermal transducers into a plurality of blocks, and selectively and time-divisionally drive the blocks and outputs a driving signal;

a level converter which is provided for a set of a plurality of switching elements corresponding to adjacent electrothermal transducers and steps up the input driving signal; and a selection circuit which selects, from the adjacent switching elements on the basis of an externally input selection signal, a supply destination of the driving signal output from the level converter.

2. The substrate according to claim 1, further comprising a time-divisional selection circuit which generates the block enable signal.

3. The substrate according to claim 1, further comprising an ink supply port to supply ink, wherein the plurality of electrothermal transducers are arrayed along the ink supply port, and the level converter is arranged along an array of the electrothermal transducers.

4. The substrate according to claim 3, further comprising a selection signal level converter which steps up the externally input selection signal, wherein the stepped up selection signal is supplied to the selection circuit.

5. The substrate according to claim 2, wherein wirings of the print data signal and the block enable signal are arranged in a direction along a longitudinal direction of the ink supply port.

6. The substrate according to claim 1, wherein the element substrate is for an inkjet printhead.

7. A printhead which has an element substrate having a plurality of electrothermal transducers and a plurality of switching elements provided in correspondence with the plurality of electrothermal transducers to drive the electrothermal transducers, the element substrate comprising:

an electrothermal transducer selection circuit which receives a print data signal and a block enable signal to divide the plurality of electrothermal transducers into a plurality of blocks, and selectively and time-divisionally drive the blocks and outputs a driving signal;

a level converter which is provided for a set of a plurality of switching elements corresponding to adjacent electrothermal transducers and steps up the input driving signal; and a selection circuit which selects, from the adjacent switching elements on the basis of an externally input selection signal, a supply destination of the driving signal output from the level converter.

8. The printhead according to claim 7, wherein the element substrate further comprises a time-divisional selection circuit which generates the block enable signal.

9. The printhead according to claim 7, wherein the element substrate further comprises an ink supply port to supply ink, the plurality of electrothermal transducers are arrayed along the ink supply port, and the level converter is arranged along an array of the electrothermal transducers.

10. The printhead according to claim 9, wherein the element substrate further comprises a selection signal level converter which steps up the externally input selection signal, and the stepped up selection signal is supplied to the selection circuit.

11. The printhead according to claim 8, wherein the element substrate, wirings of the print data signal and the block enable signal are arranged in a direction along a longitudinal direction of the ink supply port.

12. A head cartridge which has a printhead including an element substrate having a plurality of electrothermal transducers and a plurality of switching elements provided in correspondence with the plurality of electrothermal transducers to drive the electrothermal transducers, and an ink tank containing ink, the element substrate comprising:

an electrothermal transducer selection circuit which receives a print data signal and a block enable signal to divide the plurality of electrothermal transducers into a plurality of blocks, and selectively and time-divisionally drive the blocks and outputs a driving signal;

a level converter which is provided for a set of a plurality of switching elements corresponding to adjacent electrothermal transducers and steps up the input driving signal; and a selection circuit which selects, from the adjacent switching elements on the basis of an externally input selection signal, a supply destination of the driving signal output from the level converter.

13. A printing apparatus which has a printhead including an element substrate having a plurality of electrothermal transducers and a plurality of switching elements provided in correspondence with the plurality of electrothermal transducers to drive the electrothermal transducers, the element substrate comprising:

an electrothermal transducer selection circuit which receives a print data signal and a block enable signal to divide the plurality of electrothermal transducers into a plurality of blocks, and selectively and time-divisionally drive the blocks and outputs a driving signal;

a level converter which is provided for a set of a plurality of switching elements corresponding to adjacent electrothermal transducers and steps up the input driving signal; and a selection circuit which selects, from the adjacent switching elements on the basis of an externally input selection signal, a supply destination of the driving signal output from the level converter.

* * * * *